US007195141B2

(12) United States Patent
Elonsson et al.

(10) Patent No.: US 7,195,141 B2
(45) Date of Patent: Mar. 27, 2007

(54) STAPLER WITH BENDING ARMS WHICH CUT THE STAPLE LEGS AGAINST A PAD

(75) Inventors: Martin Elonsson, Huskvarana (SE); Peter Johansson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 11/352,370

(22) Filed: Feb. 13, 2006

(65) Prior Publication Data

US 2006/0124687 A1 Jun. 15, 2006

Related U.S. Application Data

(63) Continuation of application No. 10/496,122, filed as application No. PCT/SE02/02222 on Dec. 4, 2002, now Pat. No. 7,021,515.

(30) Foreign Application Priority Data

Jan. 11, 2002 (SE) ..... 0200074

(51) Int. Cl.
*B25C 5/02* (2006.01)

(52) U.S. Cl. ..... 227/79; 227/134; 227/155

(58) Field of Classification Search ..... 227/134, 227/155, 79, 109, 132, 154
See application file for complete search history.

(56) References Cited

U.S. PATENT DOCUMENTS

| | | | | |
|---|---|---|---|---|
| 1,962,874 A | | 6/1934 | Polzer | |
| 4,199,095 A | | 4/1980 | Yamanoi | 227/125 |
| 4,378,085 A | | 3/1983 | McVeigh | 227/79 |
| 4,844,319 A | | 7/1989 | Kurosawa | 227/79 |
| 5,413,266 A | * | 5/1995 | Jairam | 227/129 |
| 5,639,007 A | | 6/1997 | Nakamura | 227/109 |
| 5,758,813 A | | 6/1998 | Kikuchi et al. | 227/155 |
| 5,791,543 A | | 8/1998 | Udagawa et al. | 227/4 |
| 6,036,074 A | | 3/2000 | Manabe | 227/155 |
| 6,250,531 B1 | | 6/2001 | Yagi | 227/79 |
| 6,776,321 B2 | | 8/2004 | Jairam et al. | 227/134 |
| 6,820,790 B2 | | 11/2004 | Ura | 227/131 |
| 6,981,626 B1 | * | 1/2006 | Tsai | 227/79 |
| 7,124,926 B1 | * | 10/2006 | Tsai | 227/155 |

FOREIGN PATENT DOCUMENTS

| | | |
|---|---|---|
| DE | 4434513 | 8/1995 |
| EP | 0051395 | 5/1982 |
| EP | 0266700 | 5/1988 |
| EP | 0995561 | 4/2000 |

* cited by examiner

*Primary Examiner*—Scott A. Smith
(74) *Attorney, Agent, or Firm*—Miles & Stockbridge P.C.

(57) ABSTRACT

A stapler has a base section and a stapling unit. The stapling unit is pivotally attached to the base section, and the base section is pivotally attached to a baseplate. In an initial position, the base section is fixed relative to the baseplate through a releasable locking mechanism connected to the baseplate and a base section. The base section has pivoting bending arms in an area underneath a support surface for a workpiece to be stapled. When a driver has driven a staple into the workpiece to a position in which the crown of the staple is in contact with the workpiece, the locking mechanism is released, and the base section pivots and is tilted against the baseplate, causing the bending arms to pivot so that the legs of the staple are bent into a position against the workpiece. A cutting pad disposed in an area between the bending arms interacts with the bending arms to cut off excess length of the staple legs.

9 Claims, 9 Drawing Sheets

STAPLER WITH BENDING ARMS WHICH CUT THE STAPLE LEGS AGAINST A PAD

CROSS-REFERENCE TO RELATED APPLICATION

This application is a continuation of application Ser. No. 10/496,122 filed May 20, 2004, now U.S. Pat. No. 7,021,515 which is a 371 of PCT/SE02/02222 filed Dec. 4, 2002.

TECHNICAL APPLICATION

The present invention relates to a stapler designed for stapling together a workpiece, primarily a sheaf of papers. The stapler comprises a base section provided with a support surface with an open slot, on which support surface the workpiece to be stapled is placed. A stapling unit is attached to the base section in a pivoting manner by a first pivot shaft and houses a magazine, in which staples are stored, and a driver which serves to drive staples individually into the workpiece to be stapled. In the driving action, the stapling unit is pressed into contact with the workpiece and the driver acts to drive the staple into the workpiece to a bottom position, in which the crown of the staple is in contact with the workpiece and the legs of the staple extend through the workpiece and the slot in the support surface. The base section is attached to a baseplate by means of a second pivot shaft and, in an initial position, is fixed relative to the baseplate by means of a locking mechanism attached to the baseplate and the base section. The area of the base section underneath the support surface also houses pivoted bending arms. The stapling unit is further provided with a releasing device which, when the driver has driven the staple into the workpiece to the position in which the crown of the staple is in contact with the workpiece, releases the locking mechanism, whereupon the base section is tilted against the baseplate, causing the bending arms to pivot so that the legs of the staple are bent into position against the workpiece.

State of the Art

Staplers of the type described in the introduction are already known. Examples are shown in all essential respects in DE 44 34 513, U.S. Pat. Nos. 5,758,813 and U.S. 1,962,874.

However, the disadvantage of these earlier staplers is that if a staple with long legs is used, and if the sheaf of papers to be stapled consists of a few sheets only, the staple legs, when bent, will overlap to a considerable extent, producing a cumbersome and unnecessarily high staple which tends to open easily, causing the legs of the staple to catch, for example, in adjoining papers or clothing or, in the worst case, to have the very unpleasant effect of pricking the fingers of the person handling the papers.

In many instances, the approach to solving these problems has been to change the staples to suit the thickness of the sheaf of papers to be stapled or to use a number of staplers loaded with different sizes of staple. However, both of these solutions have proved difficult to implement consistently since it has proved very easy to forget which size of staple is loaded in the stapler at a particular time or, when using a number of staplers, to select the appropriate one.

A further disadvantage of earlier staplers has been the complexity of their locking mechanisms and releasing devices, which has made them expensive to manufacture.

Problems

There exists, therefore, a need for a stapler which will staple together a workpiece in such manner that the staple is always of a suitable size, regardless of how thick or thin the stapled workpiece is, and is also of simple design in terms of its locking mechanism and releasing device.

Solution

The problems described are solved in the present invention in the form of a stapler of the type described in the introduction, which stapler is characterised in that the underside of the support surface is provided with a cutting pad in the space between the bending arms, which cutting pad interacts with the bending arms to cut off the excess length of the staple legs when these are being bent into position against the underside of the workpiece by the bending arms.

In a preferred embodiment, the locking mechanism incorporates a first hinged joint which, by means of a first hinge pin, is attached to the baseplate in a pivoting manner and a second hinged joint which, by means of a second hinge pin, is attached to the base section in a pivoting manner, and which hinged joints, by means of a third hinge pin, are attached to each other in a pivoting manner, and which third hinge pin is, by means of an elastic element, moved against a stop surface to a stop position in which the hinged joints are in an over-dead-centred position and in which the base section is fixed relative to the baseplate.

In yet another preferred embodiment, the releasing device consists of a link which is attached to the stapling unit by a pivoting arrangement, which link is, at a first end, acted on by the driver and, at a second end, is in disengaging contact with at least one of the hinged joints of the locking mechanism in the vicinity of the first pivot shaft when the driver is in the bottom position, thus releasing the locking mechanism.

PREFERRED EMBODIMENT

The invention will be described below with reference to a preferred typical embodiment as shown in the figures.

Figure 1:
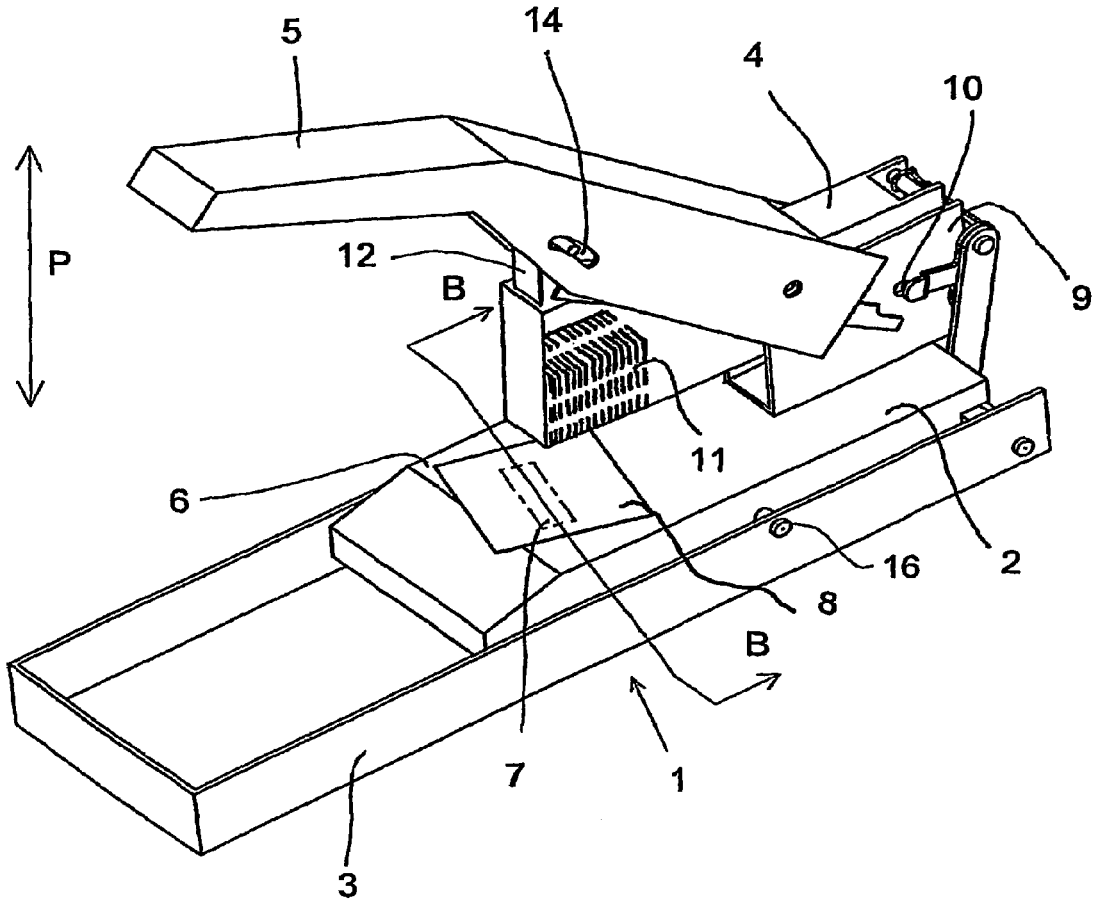
FIG. 1 is a view of a stapler in accordance with the present invention as viewed obliquely from the front.
Figure 2:
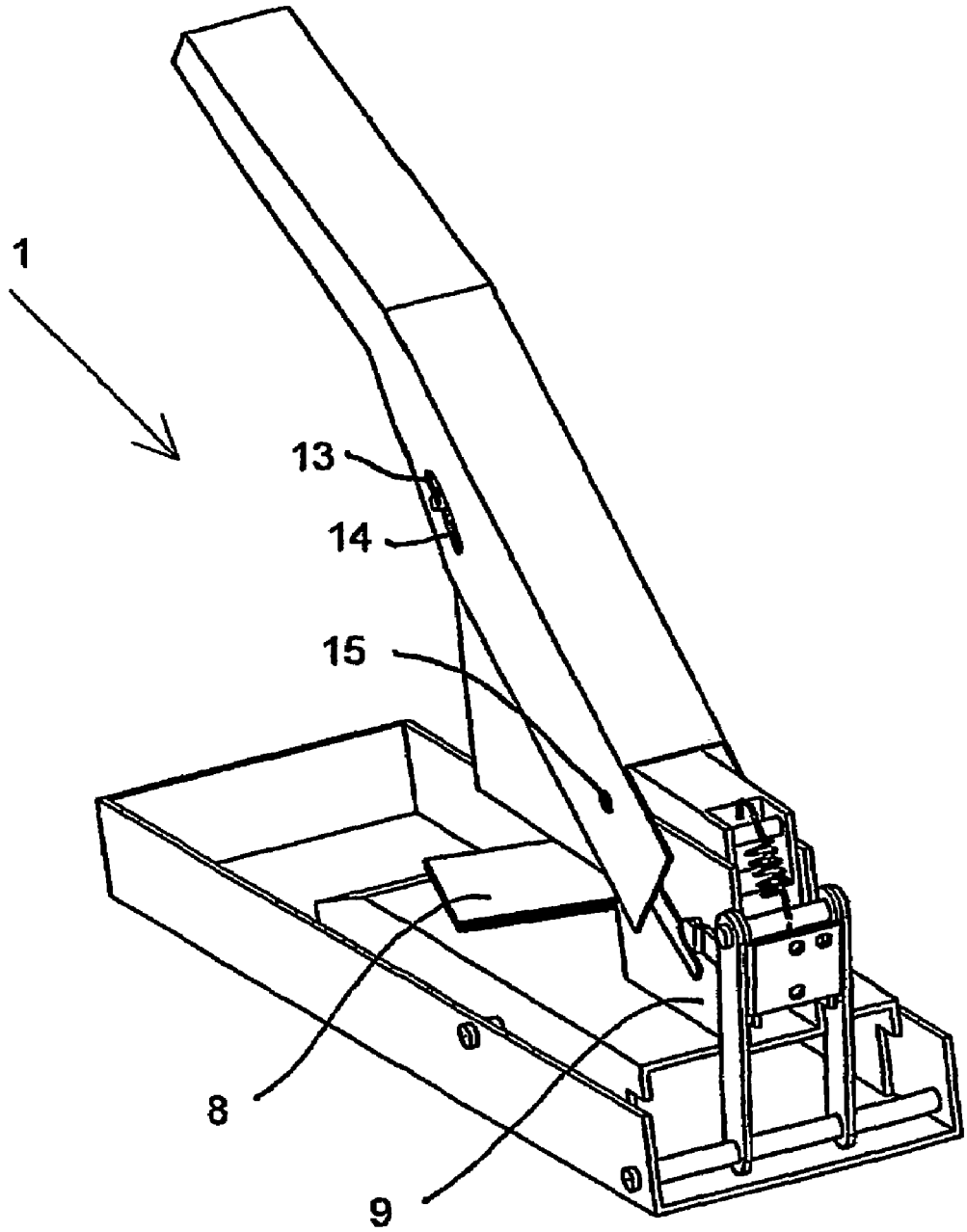
FIG. 2 is a view of a stapler in accordance with the present invention as viewed obliquely from the rear.

FIGS. 1 and 2 show a stapler 1 comprising a base section 2, a baseplate 3, a stapling unit 4 and an operating arm 5. The base section 2 is provided with a support surface 6, in which a slot 7 is located. A workpiece 8 to be stapled, primarily a sheaf of papers, is positioned over the slot 7. The base section includes a channel-shaped bracket 9 which is integrally attached to the base section by means of screws, rivets, welding, brazing or other means familiar to the expert. A first pivot shaft 10 connects the stapling unit 4 to the bracket 9 in a pivoting manner. The stapling unit houses a magazine of staples 11 as indicated by the dashed lines in FIG. 1. The stapling unit further houses a staple driver 12, which drives staples individually into the workpiece to be stapled and whose operation will be clear from the further description below. The staple driver 12 is provided with integral studs 13, which are shown most clearly in FIGS. 3–5 and which connect the driver to, the operating arm 5 by extending through slots 14 in the operating arm, only one of which is shown in the figures. The operating arm is further connected to the bracket 9 in a pivoting manner through a pivot joint 15. The operating arm enables the stapling unit and driver to be moved in the direction of the double-headed arrow P. Since the operating arm is not essential to the function of the invention, it will not be described further below. The figures also show a second pivot shaft 16, which connects the base section 2 to the baseplate 3 in a pivoting manner.

Figure 3:
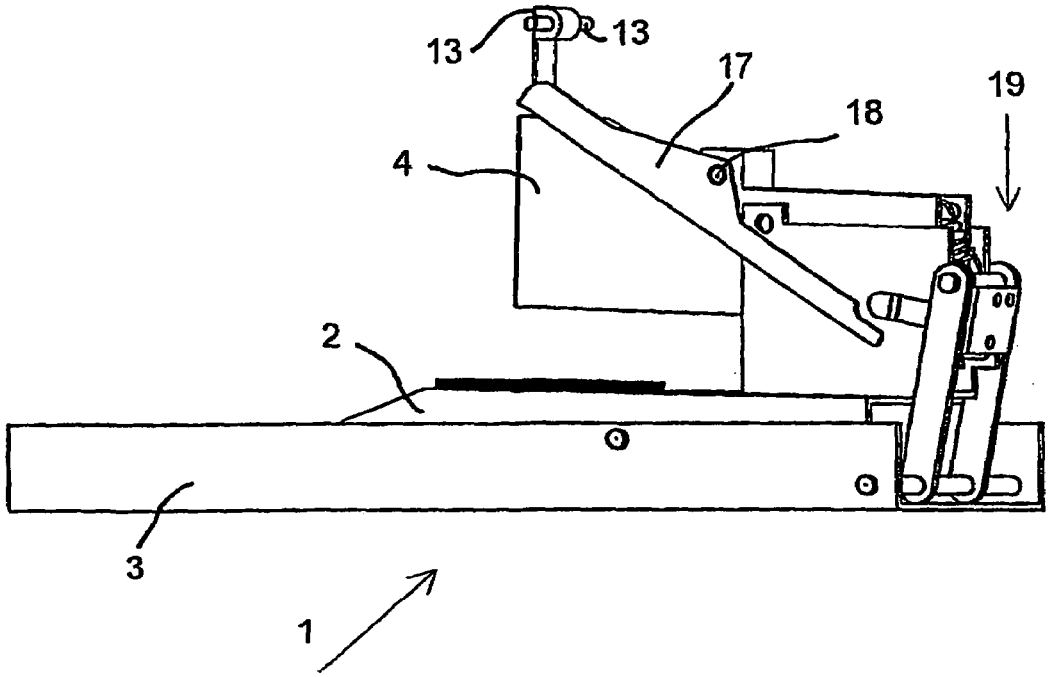
FIG. 3 is a view of a stapler in an initial position, with the operating handle of the stapler omitted.
Figure 4:
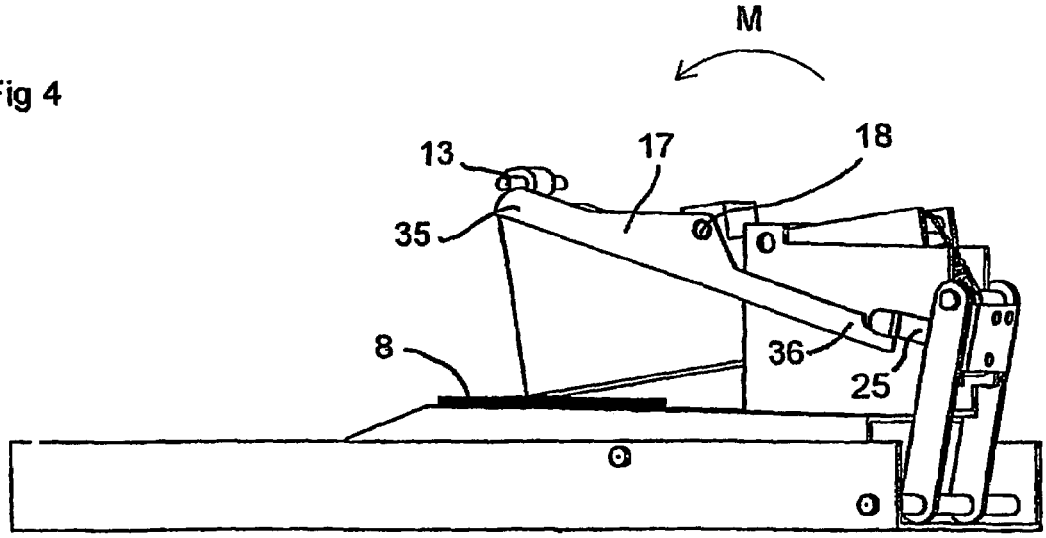
FIG. 4 is a view corresponding to FIG. 3, showing the stapler in an intermediate position.
Figure 5:
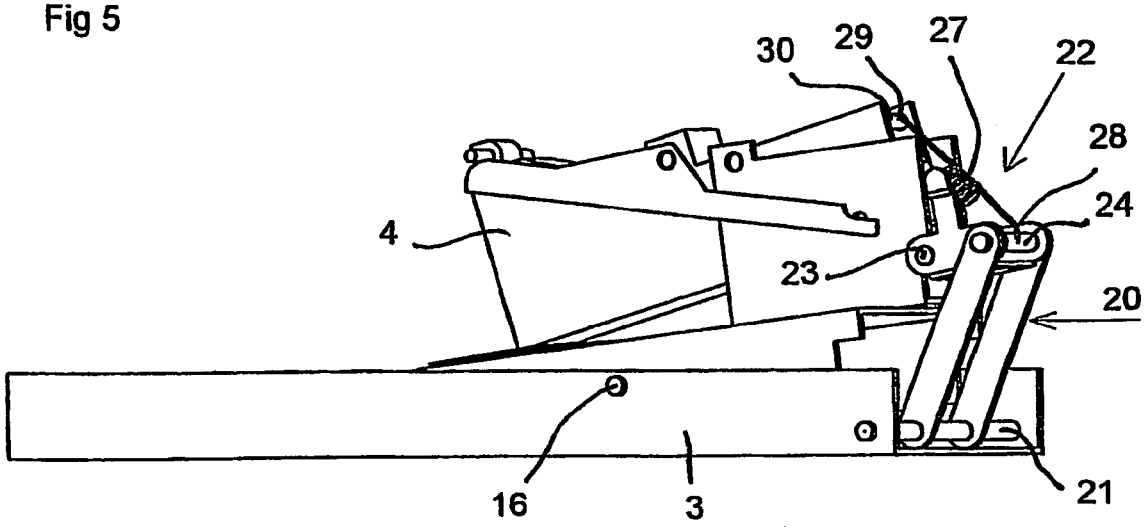
FIG. 5 is a view corresponding to FIGS. 3 and 4, showing the stapler in a final position.

FIGS. 3–5 shows the stapler 1 without the operating arm 5. The figures show a link 17 which is connected in known manner to the stapling unit 4 through a pivot arrangement 18. The figures also show a locking mechanism 19 which, in an initial position (see FIG. 3), fixes the base section 2 relative to the baseplate 3 and, in an unlocked position (see FIG. 5), permits the base section to be tilted about the second pivot shaft 16 as shown in FIG. 5.

Figure 6:
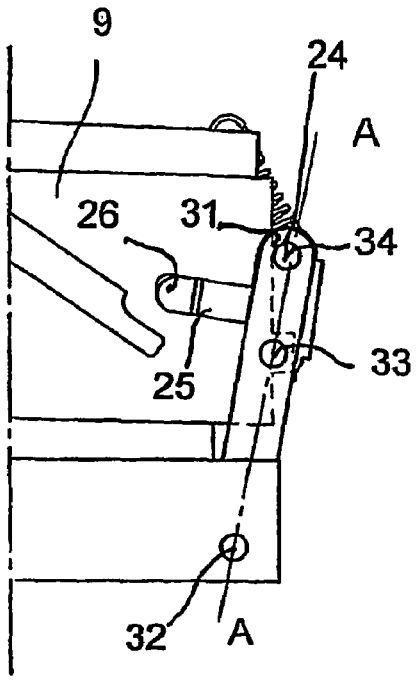
FIG. 6 is a detail view of the locking mechanism incorporated in the present invention in an operating position corresponding to that shown in FIG. 3.
Figure 7:
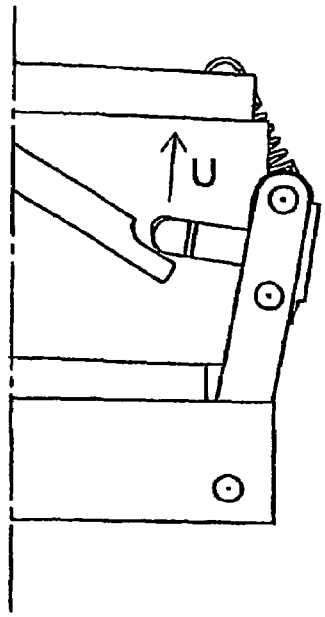
FIG. 7 is a detail view corresponding to FIG. 6, in which the locking mechanism is shown in an operating position corresponding to that shown in FIG. 4.
Figure 8:
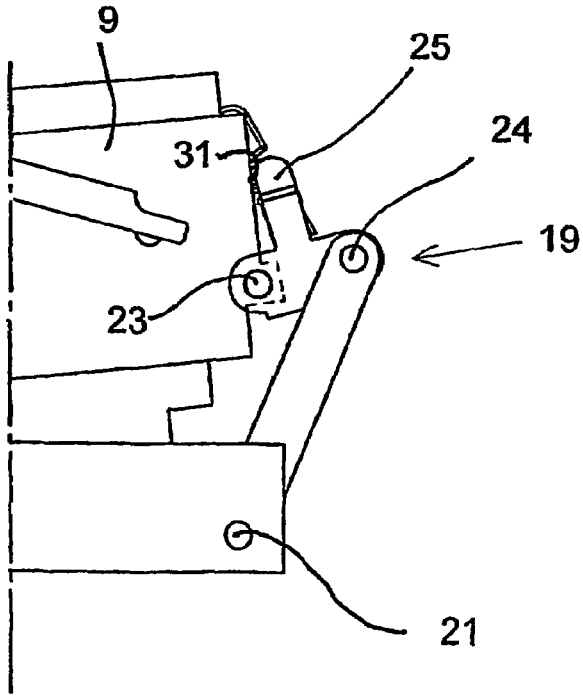
FIG. 8 is a detail view corresponding to FIGS. 6 and 7, in which the locking mechanism is shown in an operating position corresponding to that shown in FIG. 5.
Figure 9:
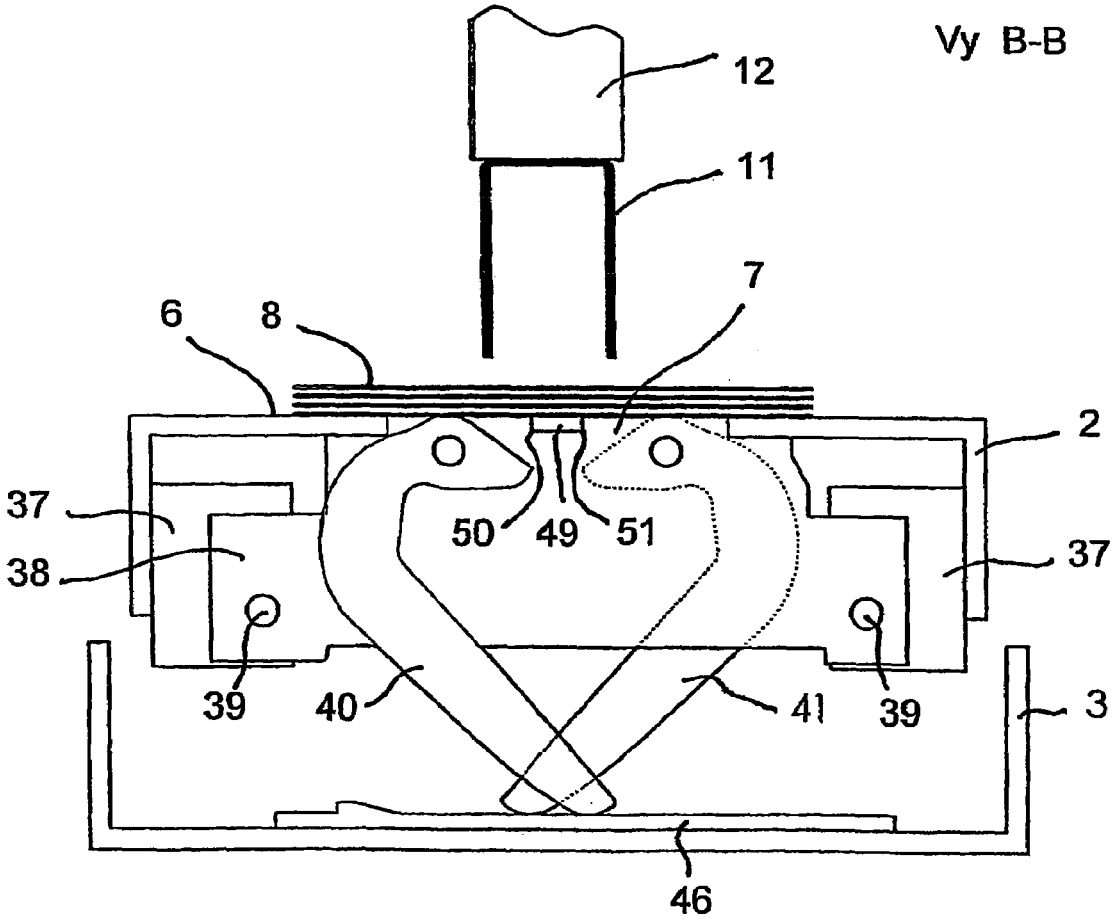
FIG. 9 is a detail view showing the bending arms incorporated in the invention in a position before a staple is driven into the workpiece.
Figure 10:
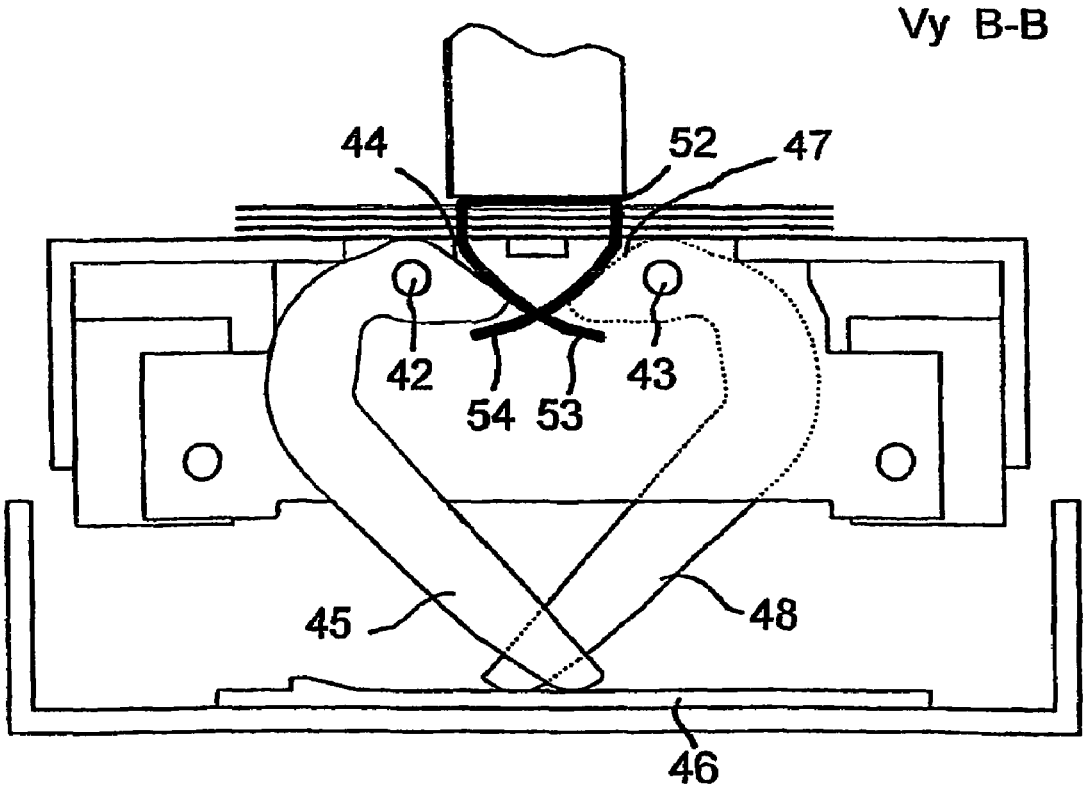
FIG. 10 is a detail view showing the bending arms in a position after a staple has been driven into the workpiece.

The design and function of the link 17 and locking mechanism 19 will be described in further detail below with reference to FIGS. 3–8. The locking mechanism comprises a first hinged joint 20, which is attached to the baseplate 3 in a pivoting manner by means of a first hinge pin 21, and a second hinged joint 22, which is attached to the bracket 9 in a pivoting manner by a second hinge pin 23. A third hinge pin 24 connects the first and second hinged joints in a pivoting manner. The second hinged joint is provided with an integral arm 25 which, when the locking mechanism is in the initial, position as shown in FIG. 3, extends across the area of the fulcrum 26 of the first pivot shaft 10, as indicated by a dot in FIG. 6. An elastic element 27 in the form of a coil spring is attached, at its first end 28, to the third hinge pin 24 and, at its second end 29, to an attachment pin 30 attached to the stapling unit 4. The elastic element 27 pulls the third hinge pin 24 against a stop surface 31 on the bracket 9. The fulcrums of the hinge pins 21, 23 and 24 are 32, 33 and 34 respectively. When the elastic element 27 pulls the third hinge pin 24 into contact with the stop surface 31, the fulcrum 34 of the third hinge pin 24 assumes an over-dead-centred position as shown in FIG. 6, the fulcrum 34 being located to the left of line A—A, which line is an extension of that interconnecting the fulcrums 32 and 33. In this position, the contact between the third hinge pin 24 and the stop surface 31 prevents the base section 2 from tilting downward against the baseplate 3 in the manner shown in FIG. 5 and the over-dead-centred position of the third hinge pin 24 prevents the base section from tilting upward from the baseplate in a direction opposite to that shown in FIG. 5. The figures further show that the link 17 comprises a first end section 35, which interacts with the driver studs 13, and a second end section 36, which interacts with the arm 25. When the stapling unit has been pressed into contact with a workpiece 8 and the driver has driven a staple into the workpiece, the studs 13 cause the link 17 to rotate in a counterclockwise direction about its pivoted arrangement 18, which direction is indicated by the arrow M in FIG. 4. In this position, the end 36 comes into contact with the arm 25, which is moved upward in the direction indicated by the arrow U in FIG. 7, moving the fulcrum 34 to the right of the line A—A, whereupon the locking mechanism 19 is released and becomes free to assume the position shown in FIG. 8, enabling the base section 2 to be tilted about the second pivot shaft 16 into the position shown in FIG. 5. Thus, the parts 12, 13, 17 and 25 comprise a releasing device for the locking mechanism 19. Although the figures show the arm 25 integrated with the second hinged joint, it will be easily seen by the expert that the arm 25 may, alternatively, be integrated with the first hinged joint 20 without altering the invention.

FIGS. 9–12 are schematic, detailed views through section B—B in FIG. 1. The figures show the baseplate 3, the base section 2 and the slot 7 provided in the base section. The base section 2 is provided with flanges 37 to which a lateral plate 38 is attached by means of fasteners 39. A first bending arm 40 and a second bending arm 41 are attached to the lateral plate in a pivoting manner by means of pins 42 and 43 respectively. The location of the bending arms is such that one of these is located behind the lateral plate 38 and the second is located in front of the lateral plate 38. This arrangement is necessary when a staple 11 is driven downward with a leg on either side of the plate 38, but since it is not essential to the operation of the invention, it will not be dealt with further in this document. The bending arm 40 is provided with a bending surface 44 and a lever arm 45, which interacts with a spacer 46 attached to the baseplate 3. The bending arm 41 is provided with a bending surface 47 and a lever arm 48, which interacts with the spacer 46. The area for the slot 7 in the area of the base section 2 between the bending arms houses a cutting pad 49 provided with a first cutting edge 50, which interacts with the bending surface 44, and a second cutting edge 51, which interacts with the bending surface 47. The function of the cutting pad will be clear from the following description.

Figure 11:
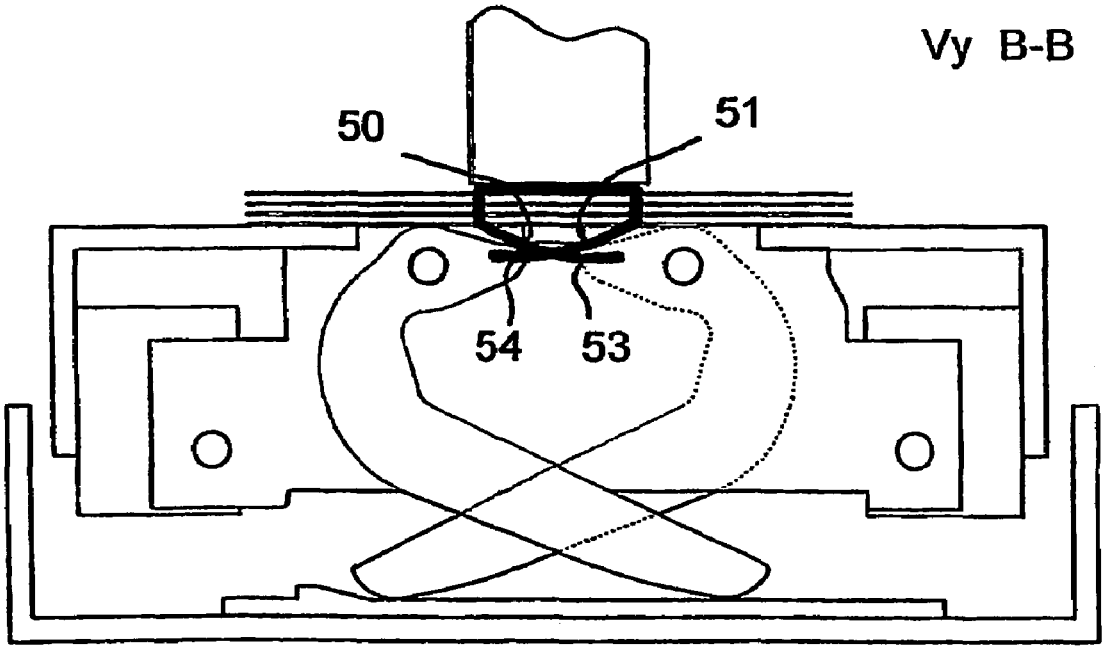
FIG. 11 is a detail view showing the bending arms when they have bent the legs of the staple into a position immediately prior to cutting.
Figure 12:
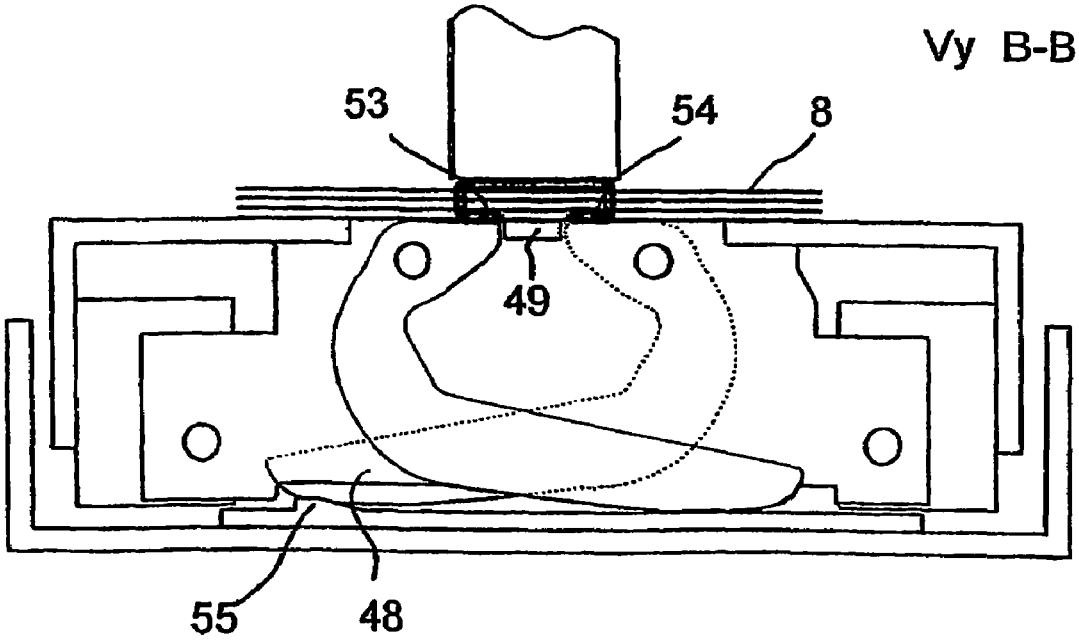
FIG. 12 is a detail view showing the bending arms when they have bent the legs of the staple into position against the workpiece.

The function of the bending arms and cutting pad will be described in further detail below with reference to FIGS. 9–12. The workpiece 8 to be stapled is placed on the support surface 6. The stapling unit 4, which is not shown in the figures, is pressed downward into contact with the workpiece and the driver 12 drives a staple 11 downward through the workpiece into the position shown in FIG. 10. In this position, the driver has driven the crown 52 of the staple into contact with the workpiece, and the legs 53 and 54 of the staple are in contact with the respective bending surfaces 44 and 47. In this position, the link 17 has released the locking mechanism 19 (see FIG. 5), enabling the base section 2 to be tilted downward against the baseplate 3. When the base section is tilted downward against the baseplate, the lever arms 45 and 48 respectively are acted upon by the spacer 46 and the bending arms pivot, causing the bending surfaces to bend the legs of the staple as shown in FIG. 11. In the position shown in FIG. 11, the bending arms have bent the legs of the staple into contact with the cutting edges 50 and 51 respectively of the cutting pad. When the base section is pressed further downward against the baseplate, the excess lengths of staple leg are cut off against the cutting edges and the bending arms bend the staple legs into contact with the underside of the workpiece 8 in the manner shown in FIG. 12, producing a staple with legs which do not overlap each other regardless of whether the workpiece is thick or thin.

As shown in FIG. 1, the slot 7 is positioned at an angle to the longitudinal axis of the stapler, which means that the lever arms of the bending arms are at different distances from the pivot shaft 16. This is compensated for by providing the spacer 46 with a projection 55, which interacts with the lever arm 48 in such manner that each bending arm bends the respective leg of the staple into an equal degree of contact with the workpiece 8.

This angled position is not necessary and in those instances in which the slot is positioned perpendicular to the longitudinal axis, the lever arms can easily be positioned so that the projection can be omitted. Thus, the projection is not necessary to the operation of the invention and will not be described further in this document.

The stapler as a whole is described below in the context of a stapling operation with reference to FIGS. 1–12. A workpiece 8 to be stapled, primarily a sheaf of papers, is placed on the support surface 6 above the slot 7. The stapling unit 4 is pressed downward against the workpiece by means of the operating arm 5 and the driver 12 is pressed further downward to drive a staple 11 through the workpiece 8. When the driver has driven the staple into the position in which the crown 52 of the staple is in contact with the workpiece 8 (see FIG. 10), the studs 13 on the driver 12 act on the first end section 35 of the link 17, causing the link 17 to pivot counterclockwise about the hinged joint 18, whereupon the second end section 36 is brought into contact with the arm 25 and lifts it in an upward direction U (see FIG. 7), moving the locking mechanism 19 to a release position and pressing the base section against the baseplate 3. In the course of this movement, the bending arms bend the legs of the staple against the workpiece, while the bending arms and cutting pad simultaneously interact to cut the legs of the staple to non-overlapping lengths (see FIGS. 9–12).

The invention is not limited to the foregoing description, but is limited only by the following claims.

The invention claimed is:

1. A stapler comprising:

a manually operated stapling unit constructed to drive a staple into a workpiece; and a manually operated bending and cutting mechanism constructed and disposed to bend legs of the staple against the workpiece and to cut off excess length of the legs when the staple is driven into the workpiece, wherein the stapler has a base, and an operating arm constructed and disposed for engagement with a user's hand and thereby to produce manual operational movement of the operating arm relative to the base, wherein the stapling unit is coupled to the operating arm to drive a staple into the workpiece in response to manual operational movement of the operating arm, and wherein the bending and cutting mechanism is responsive to manual operational movement of the operating arm to bend legs of the driven staple and to cut off excess length of the legs of the driven staple.

2. The stapler of claim 1, wherein the operating arm is supported for pivotal operational movement, and wherein first, the stapling unit, and second, the bending and cutting mechanism, operate during respective first and second portions of pivotal operational movement of the operating arm.

3. The stapler of claim 2, wherein the operating arm and the stapling unit are pivotally supported on a first part of the base that is pivotally supported on a second part of the base, wherein the stapling unit includes a staple magazine and a staple driver coupled to the operating arm, and wherein the first base part has a slot over which the workpiece is supported and at which a staple is driven by the staple driver until a crown of the driven staple abuts the workpiece and legs of the driven staple extend through the workpiece and the slot into a region beneath the slot, at which pivotal bending and cutting arms of the bending and cutting mechanism are disposed for engagement with the legs of the driven staple.

4. The stapler of claim 3, wherein the stapler includes a lock mechanism that is locked to prevent pivotal movement of the first base part toward the second base part during the first portion of the pivotal operational movement of the operating arm, and that is released to permit pivotal movement of the first base part toward the second base part during the second portion of the pivotal movement of the operating arm.

5. The stapler of claim 4, wherein the lock mechanism has a linkage coupled to the operating arm.

6. The stapler of claim 5, wherein the bending and cutting arms operate in response to the pivotal movement of the first base part toward the second base part.

7. The stapler of claim 6, wherein the bending and cutting arms cooperate with cutting edges beneath the slot.

8. The stapler of claim 7, wherein the cutting edges are on a pad.

9. The stapler of claim 7, wherein the construction of the stapler is such that the legs of the driven staple engage bending surfaces of the bending and cutting arms to bend the legs toward a position at which they are oriented to cross one another, then the bending and cutting arms operate in response to the pivotal movement of the first base part toward the second base part to bend the legs to a position at which excess length of the legs is cut off, and then the bending and cutting arms operate to bend the remainder of the legs against the workpiece.

* * * * *